US006477951B2

(12) United States Patent
Fujimoto

(10) Patent No.: US 6,477,951 B2
(45) Date of Patent: Nov. 12, 2002

(54) SHEET-FED PRESS

(75) Inventor: Shinichi Fujimoto, Hiroshima-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/779,548

(22) Filed: Feb. 9, 2001

(65) Prior Publication Data

US 2001/0013284 A1 Aug. 16, 2001

(30) Foreign Application Priority Data

Feb. 10, 2000 (JP) ..... 2000-032890
Feb. 10, 2000 (JP) ..... 2000-033825

(51) Int. Cl.[7] ..... B41F 13/24; B41F 5/16; B41F 21/00; B41L 47/46

(52) U.S. Cl. ..... 101/232; 101/53; 101/183; 101/420

(58) Field of Search ..... 101/53, 232, 183, 101/420

(56) References Cited

U.S. PATENT DOCUMENTS 5,816,155 A * 10/1998 Stephan ..... 101/232
5,839,366 A * 11/1998 Schaede ..... 101/232
5,927,198 A * 7/1999 Tada ..... 101/232
6,135,026 A * 10/2000 Kalbantner et al. ..... 101/232

FOREIGN PATENT DOCUMENTS

JP 10-109404 4/1998

* cited by examiner

*Primary Examiner*—Andrew H. Hirshfeld
*Assistant Examiner*—Marvin P. Crenshaw
(74) *Attorney, Agent, or Firm*—Crowell & Moring LLP

(57) ABSTRACT

A sheet-fed press includes a first press cylinder and a second press cylinder. A first air supply chamber and a first air vent is located in the upstream segment of the flow of a sheet. A second air supply chamber and second air vent is located in the downstream segment of the flow of the sheet. Air from the second air supply chamber is blown through the second air vent in the direction that the second cylinder is rotating.

12 Claims, 8 Drawing Sheets

SHEET-FED PRESS

BACKGROUND OF THE INVENTION

1. Field of the Invention

This invention concerns a sheet-fed press in which the paper feed is stabilized. More specifically, the invention concerns stabilizing the movement of the sheet of paper in a sheet-fed press. The sheet-fed press according to this invention has first and second press cylinders. The first press cylinder is defined as an intermediate cylinder or a delivery cylinder whose curved surface serves to guide the sheet through the space between the curved surface and a sheet guide unit. The second press cylinder is defined as an impression cylinder or the like which is positioned next to the first press cylinder via a reception area.

2. Description of the Related Art

Multiple-color sheet-fed presses which employ a series of printers each of which prints a different color ink are well known in the prior art. As can be seen in FIG. 6, the basic structural elements of such presses are feeder unit A, which consists of feeder device 39; printer unit B, which has four printers, 132*a*, 132*b*, 132*c* and 132*d*, arrayed in tandem to print cyan, magenta, yellow and black; and delivery unit C, here paper delivery unit 04.

In multiple-color sheet-fed presses with this configuration, a sucker unit with an inlet for sheets 11, which are piled on table 141 of the feed unit 39, separates a single sheet and transports it on conveyor 120. Swing gripper 121*a* delivers the sheet to intermediate cylinder 121*b* of printer 132*a*. The sheet is fed between blanket cylinder 22*a* and impression cylinder 23*a*, and the first color is printed.

Once the first color has been printed, the sheet is fed out between the blanket cylinder 22*a* and impression cylinder 23*a* and taken up by intermediate cylinder 27*a* of the second printer 132*b*. From the intermediate cylinder 27*a*, the sheet is delivered to impression cylinder 23*b*. The next process, the printing of the second color, is executed by blanket cylinder 22*b* and impression cylinder 23*b*.

The subsequent colors are printed one after the other. When sheet 11 is fed out between blanket cylinder 22*d* and impression cylinder 23*d*, which perform the final-stage printing, it is pulled onto delivery cylinder 35 of delivery unit C. From delivery cylinder 35, the now completely printed sheet 11 is taken onto chain conveyor 124 and transported to delivery unit 04, where it is added to the stack on table 40 of the unit 04.

Generally, the sheets 11 which are printed in a sheet-fed press are of a thickness which ranges from 0.04 m/m to 0.8 m/m. At times, high-rigidity sheets of metal plate or synthetic resin might also be printed. As the sheet is fed from printer 132*a* to printer 132*b* to print the various colors, various mishaps may occur. A thin sheet of paper will generally have low rigidity, and its rear portion will tend to flap. A thicker sheet of paper or sheet metal will have high rigidity, and its reaction force (stability) against the centrifugal force of rotation and its own curvature will cause its rear portion to separate from impression cylinder 23, and collide with the sheet guide unit 1' below the cylinder resulting a paper rebounding.

When the paper flaps or rebounds in this way, the print may be smudged or the paper folded or torn. This phenomenon is a significant cause of a reduction in print quality. Two typical methods employed to counteract this problem are to use a skeleton cylinder or a drum cylinder for the intermediate cylinder 27. This allows the most appropriate scheme to be used for the rigidity of whatever sheet is being printed.

The example shown in FIG. 7(A) is a skeleton-type intermediate cylinder 27, which is used primarily when printing thicker sheets of paper. One of these skeleton cylinders 27 is placed on each side of each printer 132. Each skeleton cylinder consists of a pair of rotors (arms) 271 which rotate on axis 270. Each arm 271 has a series of pawls 29 on its shaft 272 (see FIG. 8(A)) running from the end of arm 271 to the end of arm 271 on the opposite side of the shaft. The distinguishing feature of the skeleton cylinder 27 is that the area of the cylinder which comes in contact with impression cylinder 23 when the paper passes between them is extremely small. The sheet 100 which is being rotated forward is allowed to bend beyond point P where it comes into contact with pawls 29. In other words, the point of contact P becomes the point of action. By lengthening the distance from this point to the end of sheet 100, we reduce the reactive force exerted by the sheet in its attempt to return to its original shape.

As a result, we reduce the amount of rebounding at the end of the sheet which strikes sheet guide unit 1', the curved guide which conforms to the hypothetical circumference of the lower portion of skeleton-type intermediate cylinder 27. This scheme minimizes tears and folds; but on the other hand, because this sort of skeleton cylinder 27 provides a larger region in which the end of sheet 100 is free, a thin sheet will have more opportunity to flap.

The example shown in FIG. 7(B) is drum cylinder-type intermediate cylinder 27', which is used primarily for thinner sheets of paper. This sort of drum cylinder 27' has a number of pawls 29 in two places along the circumference of a roller which rotates on axis 270.

The feature which distinguishes drum cylinder 27' is that the amount of its surface area which comes in contact with impression cylinder 23 as sheet 100 is fed between them is maximized. Because the portion of sheet 100 which is beyond pawls 29 is guided along the circumference of the drum cylinder (27'), this scheme makes it very difficult for the end of the sheet to flap, so it minimizes doubling, tearing and other defects resulting from the end of the sheet wrinkling or flapping. However, when this sort of drum cylinder 27' is used to convey thicker varieties of paper, the fact that there is very little area where the end of the sheet is free will result in significant rebounding.

In recent years, as print quality has improved, there has been a tendency to use the skeleton cylinders even for thinner papers. To keep thin sheets from flapping, a sheet guide unit 1 is provided which has a sheet guide surface 1*d* following the contour of the lower portion of intermediate cylinder 27 (or 27') and delivery unit 35 (hereafter referred to as the intermediate cylinder). In order to address the problems in this sort of sheet-fed press, a sheet guide unit is provided in which specifically pressurized air is blown through a number of vents in the sheet guide unit into the space between intermediate cylinder 27 and surface 1*d* of the sheet guide unit. This air is blown along the bottom of sheet 11 as it passes through the space along sheet guide surface 1*d*. Because of the Bernoulli effect, the air blown through the vents causes the sheet 11 to be suspended.

One such sheet guide unit is described in Japanese Patent Publication (Kokai) Hei 10-109404. We shall explain the relevant technology with reference to FIG. 8. The sheet guide unit, which runs along the circumference of skeleton-type intermediate cylinder 27 or delivery cylinder 35, both of which are studded with pawls 29, consists of air ducts 06. On the upper surface of the air ducts 06 are numerous air vents 4*a* and 4*b*. The vents 4*a* and 4*b* face in opposite directions and are located on either side of the center of the intermediate cylinder 27 or of delivery cylinder 35. The vents distribute the air toward the outer edges of the intermediate cylinder 27. The vents 4*a* and 4*b* produce two streams of air which originate at the vents and continue to move in the directions determined by the vents. These air streams keep the sheet of paper suspended at a specified height, thus stabilizing the travel of the sheet.

In the prior art technique, then, air is blown through a space between sheet guide surface 1*d* and the intermediate cylinder underneath sheet 11. The sheet is caught on pawls 29 of skeleton-type intermediate cylinder 27, the type of cylinder used for thicker papers. The air is blown into the space from ducts 06 below the guide surface through the air vents 4*a* and 4*b*. The Bernoulli effect which results from the differential flow rate above and below the sheet causes the sheet 11 being conveyed around the circumference of the intermediate cylinder 27 to be pulled toward surface 1*d* of the sheet guide unit and to be suspended slightly above that surface as it is conveyed until it is delivered to the subsequent impression cylinder 23.

However, in this prior art technique, when the sheet exits the guide space and is released from the pawls of the skeleton cylinder, there is nothing to hold it. And particularly if the sheet is thin, the Bernoulli effect due to the flow velocity of the air stream will not be sufficient to stabilize the end of the sheet.

In addition, with this prior art technique, in the reception area for the sheet between the intermediate cylinder and the impression cylinder, in other words, at the point where the intermediate cylinder and impression cylinder come in contact with each other (and at this point in stages 2, 3 and 4), the rotation of the two cylinders creates a vortex (a rotary airflow dragged by the rotation of cylinders) in the direction that the cylinders are rotating. In particular, the turbulent boundary layer 37 shown in FIG. 1 develops above impression cylinder 23, whose lower surface lacks a sheet guide unit.

When the vortices act on the end of sheet 11 which is about to be transferred or has been transferred to impression cylinder 23 from intermediate cylinder 27, the end of the sheet will not be able to remain stabilized. Sheet 11 will, then, behave improperly, either moving around or flapping up and down. If the intermediate cylinder 27 is a skeleton cylinder, and a thinner paper is used, when the sheet 11 is transferred from skeleton cylinder 27 to the pawls of impression cylinder 23 and the rotational phase progresses, the gap between cylinders 23 and 27 will be even larger. When sheet 11 is released by pawls 29 (see FIG. 3) of the skeleton cylinder, it is very likely to move around or flap, as described above, since it is then in an unrestrained state.

With a drum-type intermediate cylinder, the end of the sheet is held between the intermediate cylinder and the impression cylinder, so it cannot move around or flap as described above. Because the sheet is clasped between two cylinders, however, a thicker and more rigid sheet will be more likely to tear or have printing defects.

The tendency of sheet 11 to be adversely affected by air vortices will vary according to its thickness. Solutions offered in the prior art, including the invention disclosed in the Japanese Patent Publication 10-109404, have not provided any means to insure that the action of sheet 11 be controlled properly, as discussed above. If, as has become common in recent years, the same printer were used to print on both thicker and thinner papers, it would be necessary to change from skeleton to drum cylinder each time a different thickness of paper is used. Practically speaking, this is simply not possible.

SUMMARY OF THE INVENTION

In view of the problems discussed above, the objective of this invention is to provide a sheet-fed press which will prevent air vortices in the reception area between the intermediate and impression cylinders from causing the end of the sheet to move around or flap; which would allow sheets of thinner grades of paper to be conveyed in a stable fashion; and which would prevent sheets of thinner grades of paper from moving around or flapping when a skeleton cylinder is used as the intermediate cylinder, so that the paper can be conveyed in a stable and continuous fashion.

Another objective of this invention is to provide a sheet-fed press which will allow paper of a wide range of thicknesses to be conveyed in a stable fashion without moving around or flapping, even when a skeleton cylinder is used as the intermediate cylinder.

Yet another objective of this invention is to provide a sheet-fed press which would control, according to the thickness of the sheet of paper, undesirable movement of the sheet resulting from air vortices in the reception area between the intermediate and impression cylinders.

To address these problems, the current invention is designed as follows. The sheet-fed press according to this invention has two printing cylinders, the first of which is an intermediate or delivery cylinder with a sheet guide unit under its lower surface consisting of a space through which the sheet can pass, and the second of which is an impression cylinder or alike positioned adjacent to the first cylinder via the reception area. This press is distinguished by the fact that it has an additional second air supply chamber in the rear side of the sheet guide surface which is located in the downstream segment of the flow of sheet, and by the fact that there are air vents in the downstream segment of the reception area through which air from the second air supply chamber is blown in the direction that the second cylinder is rotating.

In this case it is desirable that there should be an air guide side wall facing along the circumference of the second printing cylinder. This air guide side wall should be located at the downstream from the air vents of the second air supply chamber. The air stream blown through the air vents can flow along the air guide side wall and be directed toward the tangent of the second cylinder.

Since the air guide side wall consists of the wall of the second air chamber at the air vents side, no additional wall will be needed.

With the invention, the downstream portion of the air guide side wall gradually narrows as it approaches the second cylinder. The venturi effect which occurs on the downstream portion of air guide side wall will produce a negative pressure on the lower surface of the sheet being conveyed. Because the air stream is moving toward the tangent of the second cylinder, it creates a flow which can counteract the vortex near the surface created by the rotation of the second cylinder (i.e., it creates a flow opposite the direction of rotation of the second cylinder).

By canceling or reducing the speed of the vortex, this arrangement can prevent the sheet from breaking free or flapping. Even when a skeleton cylinder is used, the sheet can be conveyed without problems.

With the invention, it is desirable to provide a means to draw the air flowing along the path of rotation of the second cylinder on the downstream side of the air vents. The drawing means might be a hood which extends along the breadth of the air guide side wall so as to cover the rotary surface of the second cylinder downstream from the reception area.

With this invention, the air in the vicinity of the reception area will be collected and drawn into the hood. This will prevent the air from being dispersed and so prevent the adverse effect which the dispersed air would exert on the sheet. The hood allows the sheet to be transported more smoothly from the first cylinder to the second cylinder.

The quantity of air drawn into the drawing means should be greater than the quantity blown through the air vents. This will further insure that the air near the reception area will not be able to disperse.

It is effective to create a return channel for the air so that at least a portion of the air drawn in by the drawing means is recirculated to the second air supply chamber.

By creating the second air chamber, air vents, and return channel by which the air in the hood can recirculate back to the second air chamber, we provide a system by which we can use the continuously circulating air, by temporarily accelerating the air in the channel, to counteract the speed of the vortex. We then need no extraneous air; and we can reduce the energy required to accelerate the air. And because we need only a single air pump, we can reduce our equipment cost.

The press according to another embodiment of this invention comprises a second air blowing means to supply the air flow from the second air supply chamber as mentioned above which blows air along the circumference of the second printing cylinder from a point downstream from the reception area; a third air blowing means of an air jet unit to blow air toward the reception area between the two aforesaid cylinders from a point upstream from that reception area; and an air control means to control the air flows to the two air blowing means mentioned above, by selecting one of two air blowing means according to the thickness of the sheet being conveyed from the surface of the sheet guide unit, or by constricting the volume of air supplied to the air blowing means.

The press according to another embodiment further has a first air blowing means to supply an air stream to blow air into the space along the sheet guide unit and the first press cylinder so that the sheet is suspended slightly above the guide surface of the sheet guide unit as it is conveyed. The air control means to control the air flow mentioned above can constrict the volume of air supplied to the first air blowing means according to the thickness of the sheet.

With this invention, if for example a sheet of a thicker paper were being conveyed from the sheet guide unit to the reception area, it would select the third air blowing means to blow air toward the reception area between the two cylinders from a point upstream. If a sheet of thinner paper were being conveyed, it would select the second air blower, which is downstream from the reception area between the two cylinders, to blow air toward the second cylinder. Even if a skeleton cylinder is used as the intermediate cylinder, this scheme insures that sheets of a wide range of thicknesses can be conveyed in a stable fashion without buckling or flapping.

The air control means to control the air flow mentioned above may, not only control the control signals for selecting the air blowing means or constricting the volume of airflow supplied to the air blowing means, but also select a preset signal for the pressure to be exerted on the cylinders according to the thickness of the paper.

BRIEF DESCRIPTION THE DRAWINGS

DETAILED DESCRIPTION OF THE PREFERRED EMBODIMENTS

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration.

Figure 1:
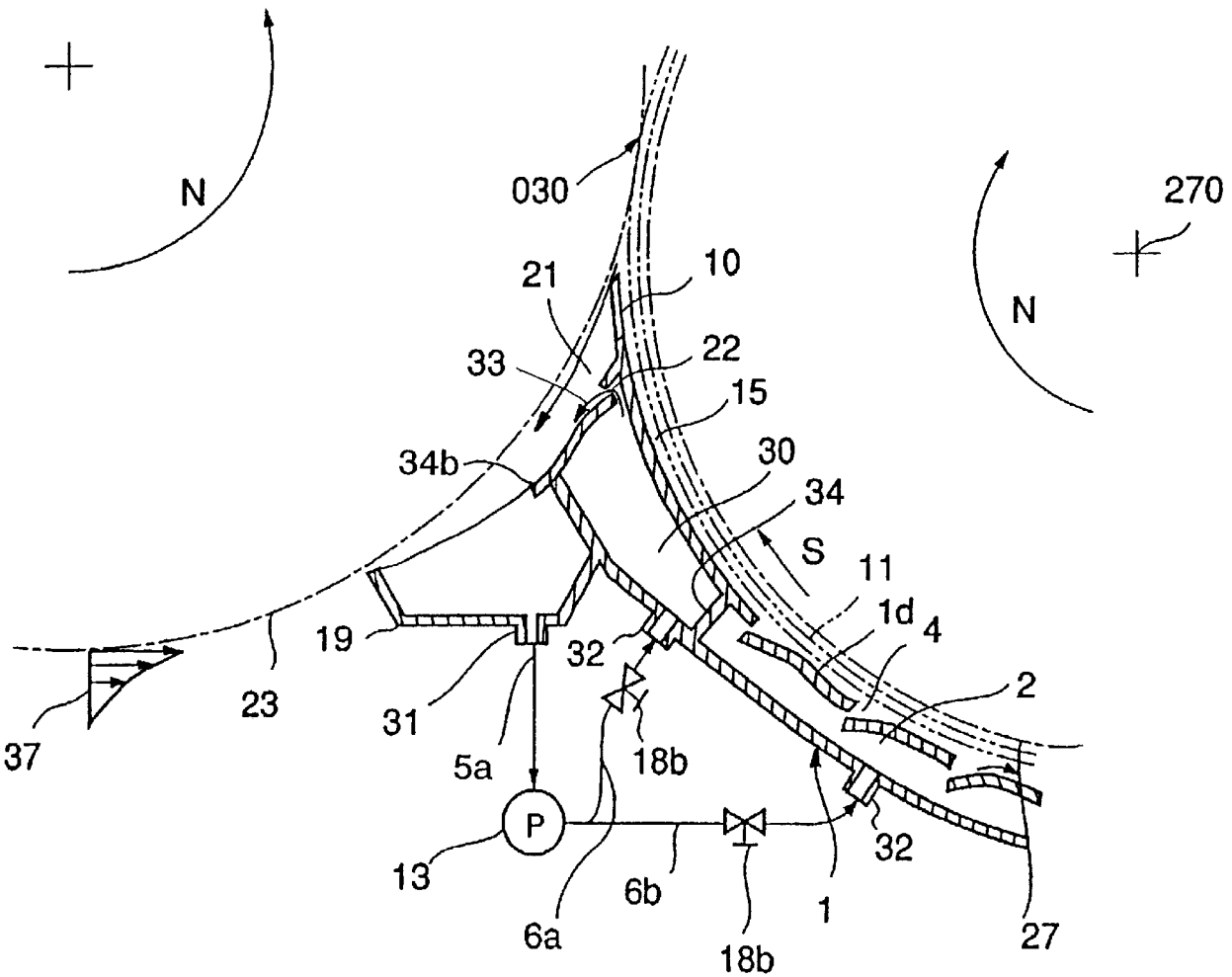
FIG. 1 is a magnified cross section (taken along line A—A in FIG. 2) of the essential parts of the reception area of a sheet guide unit in a sheet-fed press which is a first preferred embodiment of this invention.
Figure 2:
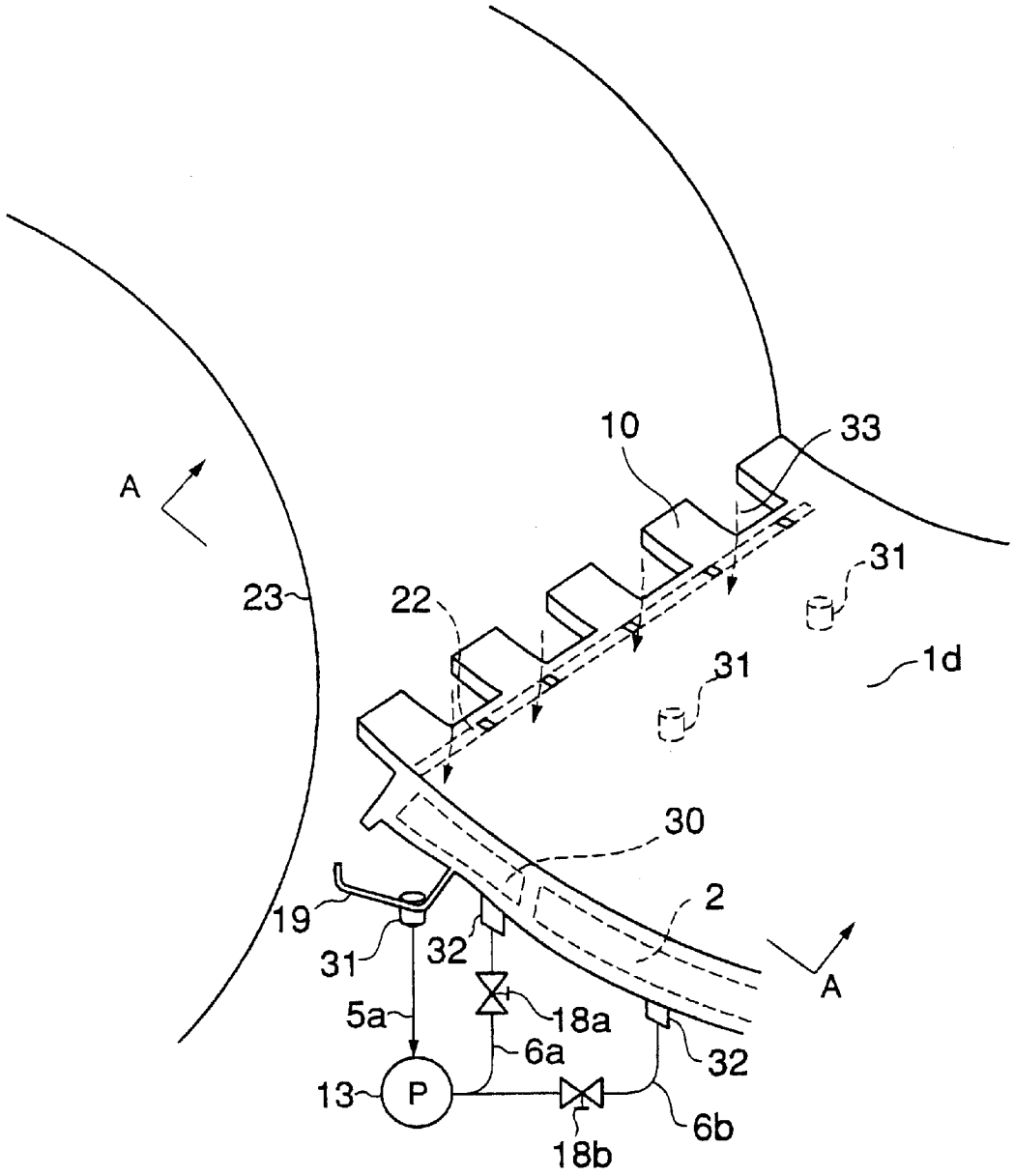
FIG. 2 is a perspective drawing of the area around the reception area.

FIG. 1 is a magnified cross section (taken along line A—A in FIG. 2) of the essential parts of the reception area of a sheet guide unit in a sheet-fed press which is a preferred embodiment of this invention. FIG. 2 is a perspective drawing of the area around the reception area.

Figure 6:
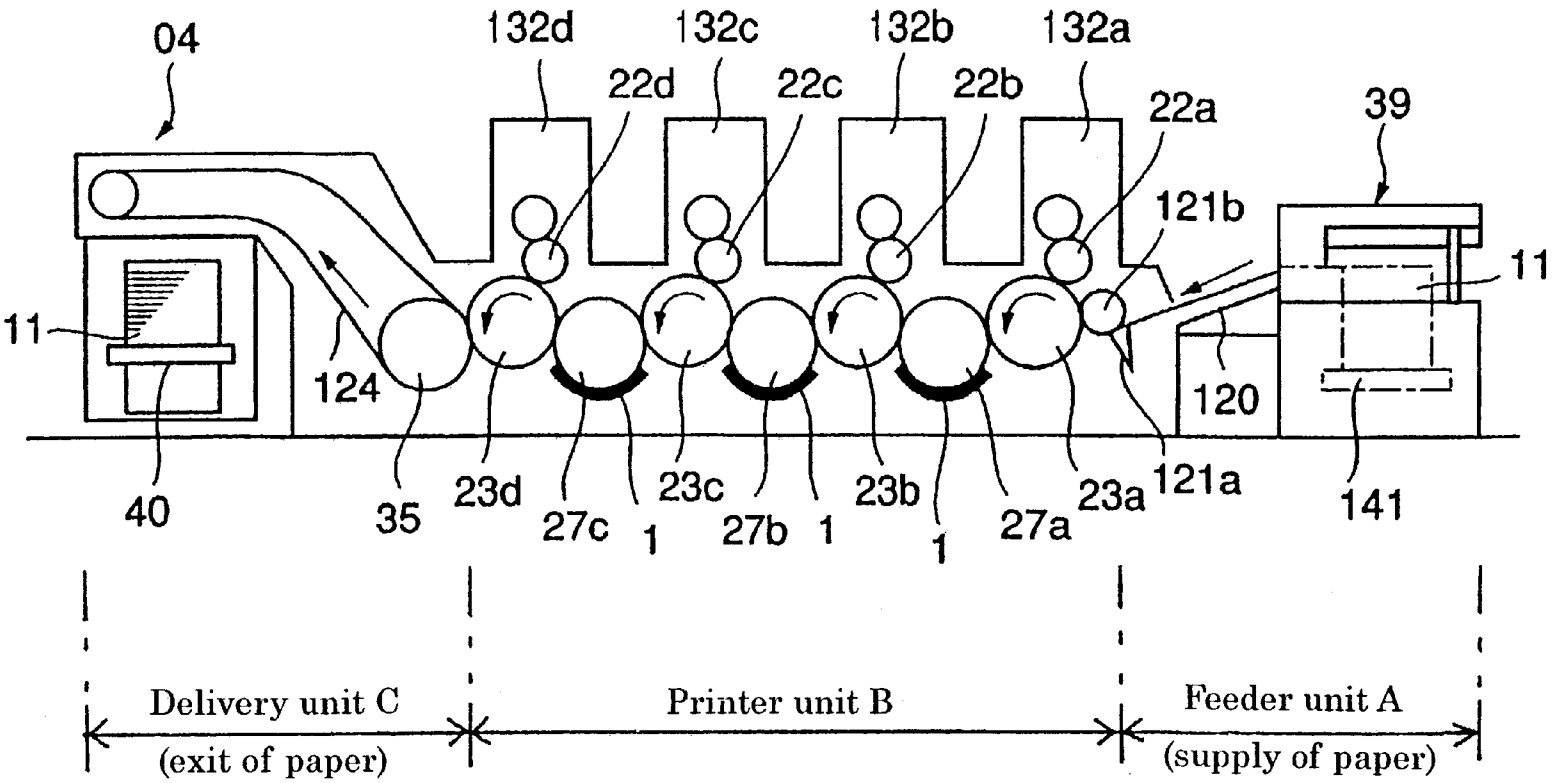
FIG. 6 shows the overall configuration of a sheet-fed press according to the prior art.
Figure 7A:
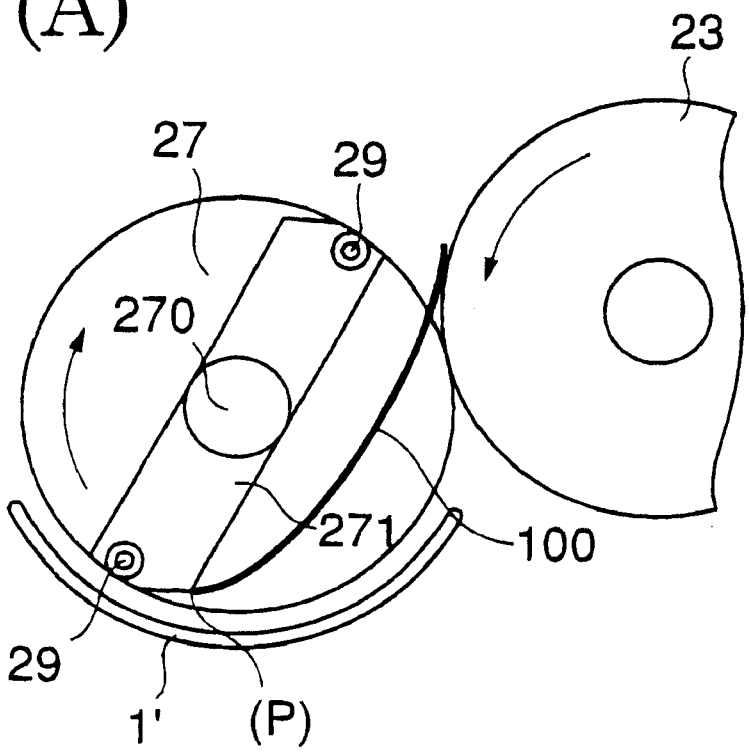
FIG. 7(A) shows a skeleton-type intermediate cylinder.
Figure 7B:
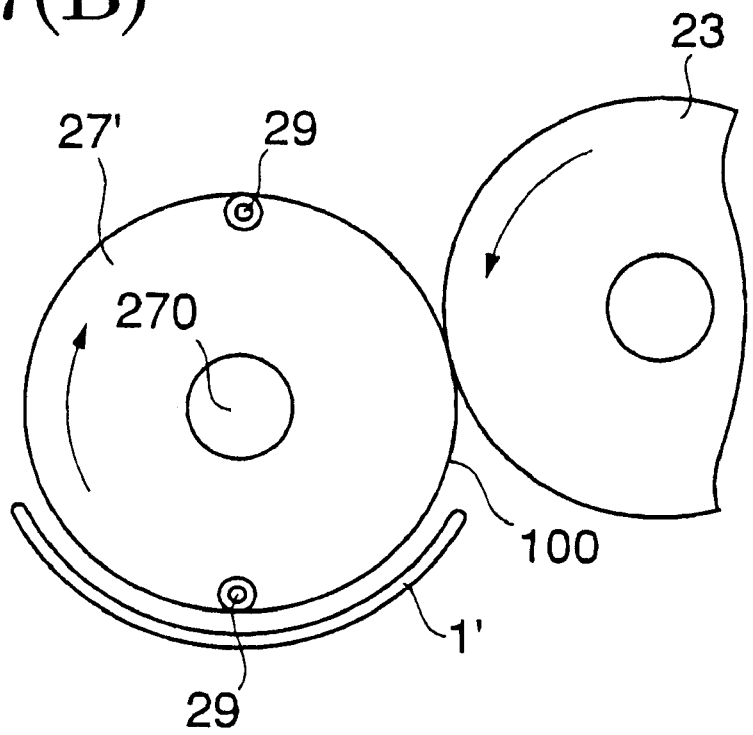
FIG. 7(B) shows a drum cylinder-type intermediate cylinder, which are prior arts.

The multiple-color sheet-fed press in which this embodiment is implemented is discussed in detail in the section concerning the prior art with reference to FIG. 6. We shall refrain from discussing if further at this point.

This embodiment concerns sheet guide unit 1, which includes sheet guide surface 1*d*, the surface which runs along the contour of the lower portion of intermediate cylinder 27 and delivery unit 35 (hereafter both referred to collectively as the intermediate cylinder). In this embodiment, a skeleton cylinder is used as the intermediate cylinder; however, it would be equally possible to use a drum cylinder. 23 is the impression cylinder; 030 is the reception area for sheet 11 between the intermediate cylinder 27 and impression cylinder 23.

Sheet guide unit 1 consists of the upper surface 1*d* (sheet guide surface) of the sheet guide unit, which describes the curve of the cylinder, the lower portion of the intermediate cylinder 27, and the space 15 between the two through which the airflow passes. Either one or two first air supply chambers 2, which if two are formed on either side of a central partition, are provided within the sheet guide unit 1 so that they take up the entire area except for the downstream portion. 4 is one of two air inlets in the sheet guide unit 1. These first air vents connect the guide space 15 and the air supply chamber 2. They face in opposite directions on either side of an imaginary line drawn from the center of the shaft of the intermediate cylinder 27. They are distributed so that they face either side of the cylinder 27. When air is blown through the inlet 6 in the direction in which the first vent opens, the sheet is maintained at a specified height so that it can be conveyed in a stable fashion.

Below the sheet 11 which is held by pawls 29 of skeleton-type intermediate cylinder 27 there is a space 15, which is between guide surface 1*d* and intermediate cylinder 27. This space has a first air chamber 2 beneath it into which air is supplied. In space 15, a stream of air is blown along the bottom of the sheet from first air vents 4 on the left and right, which face either directly parallel to the surface of the guide or in a slightly elevated direction. The differential flow velocity of the air stream above and below the sheet of paper produces the Bernoulli effect. The sheet 11 being conveyed along the surface of the intermediate cylinder 27 is pulled toward surface 1*d* of the sheet guide unit and suspended slightly above it as it moves along.

Figure 8A:
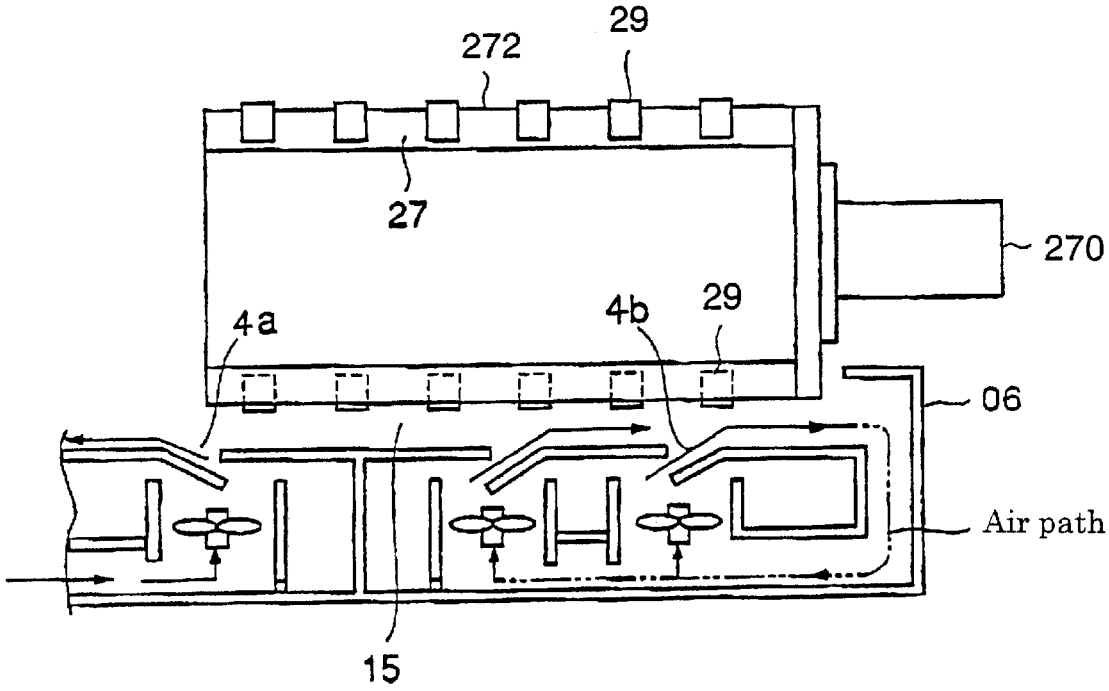
FIG. 8 shows the essential part of the press according to the prior art. (A) shows a front view of a skeleton-type intermediate cylinder, and the sheet guide unit which conforms to the hypothetical circumference of the lower portion of skeleton-type intermediate cylinder, and (B) shows the sheet guide surface.
Figure 8B:
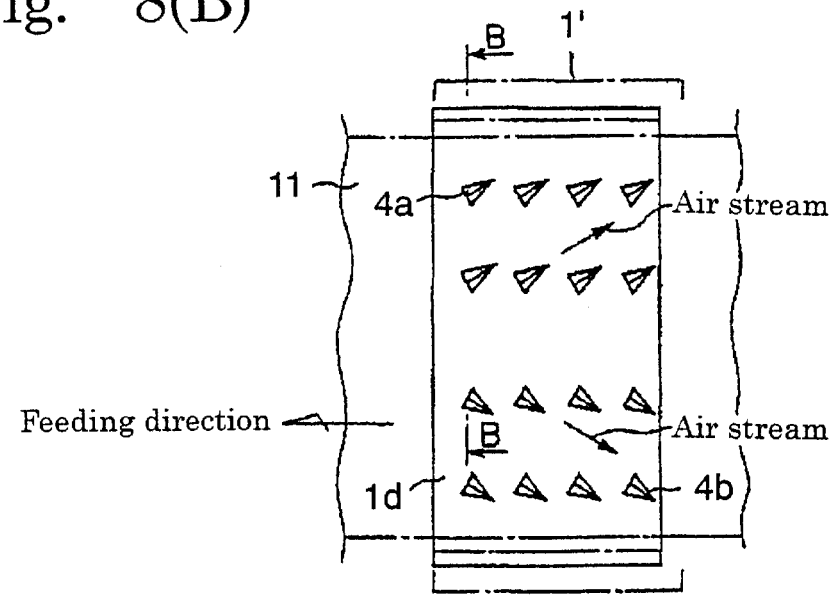

The position and orientation of the first air vents 4 are by no means limited to those shown in FIG. 8(B), but can be selected as needed.

As can be seen in FIG. 2, the downstream end of the sheet guide unit 1 with respect to the movement of the sheet, indicated by arrow S in FIG. 1, is positioned in such a way as to minimize the gap between it and impression cylinder 23 so that it can effectively guide the paper. Along its width, a number of indentations 10 are provided at intervals through which the pawls of the cylinder may pass. (These indentations 10 may all be the same size, or they may be of different sizes.)

In the sheet guide unit 1 of this embodiment, a second air chamber 30 is created by a partition in first air chamber 2 behind the downstream side of guide surface 1*d* and between the ends of indentations 10. This second chamber is formed on the downstream side with respect to the direction of movement of the sheet (indicated by arrow S) which is next to the first air supply chamber 2 and partitioned by air guide side wall 34. The other wall facing space 21, the space around reception area 030 at the juncture of the intermediate cylinder 27 and impression cylinder 23, is air guide side wall 34*b* of second air chamber 30. It is formed by the wall of the guide, which gradually approaches the surface of the impression cylinder.

There are numerous air vents 22 in the air guide side wall 34*b*. Through these vents a stream of air is blown along the rotary surface of the impression cylinder from second air chamber near the downstream end of the air guide side wall 34*b*.

As can be seen in FIG. 2, numerous air vents 22 are provided along the width of sheet guide unit 1.

Near the downstream end of the travel (in direction S) of the sheet through the sheet guide unit 1, more specifically, below the outlet of space 21 around pawls 10 in the sheet guide unit 1, is buffer hood 19. This hood covers the outlet of the space 21 from below. The stream of air coming through the vents 22 in the air guide side wall 34*b* is directed toward the outlet of space 21, and hood 19 draws it out. The hood 19, as can be seen in FIG. 2, goes all the way across sheet guide unit 1. It opens onto the surface of the impression cylinder on the outlet side of the space 21, and it covers the space below it.

Aspirating vents 31 are on the bottom of the hood 19. A number (in this example, three) of these aspirating vents 31 are provided at fixed intervals across the width of sheet guide unit 1 so that the aspiration is uniform across the sheet guide unit.

13 is an air pump which consists of a compressor. Its aspirating side is connected to aspirating vent 31 of the hood 19 through pipe 20. The discharge port of the air pump 13 is connected via air supply pipe 6*b* to air inlet 32 of the first air supply chamber 2, and via branching air supply pipe 6*a* to the second air supply chamber 30.

18*a* and 18*b* are valves which open and close the air supply pipe 6a and branching air supply pipe 6*b* or adjust how much they open.

In a sheet guide unit for a sheet-fed press with this configuration, as can be seen in FIG. 6, the sheet 11 which is conveyed by the first cylinder, impression cylinder 23 (23*a*), is grabbed by the pawls (not pictured) of intermediate cylinder 27 (27*a*) and passes through guide space 15, the space between the intermediate cylinder 27 and the sheet guide unit 1.

Air which has been pressurized to a specified pressure is supplied by the air pump 13 to the first air supply chamber 2, the chamber on the upstream side of the path S which the sheet travels in the sheet guide unit 1, through the air supply pipe 6*b*. The air stored in the air supply chamber 2 is blown onto the lower surface of sheet 11 as it passes through guide space 15. It is blown through numerous air vents 4 along surface 1*d* of the sheet guide unit.

The air stream blown through the air vents 4 causes there to be a differential flow rate above and below the sheet 11 being conveyed. A sheet 11 of a thinner paper, which is liable to move around or flap when the intermediate cylinder rotates, is pulled toward surface 1*d* of sheet guide unit 1 because of the decreased pressure due to the air flow. It passes through the guide space 15 slightly suspended at a specified height above the surface 1*d*.

A sheet 11 of a thicker, more rigid paper would have its end pulled to surface 1*d* of sheet guide unit 1 so that it was dragged across the surface as it traversed the space. The pressure of the air blown under it, however, pushes it away from surface 1*d* of sheet guide unit 1 and into guide space 15. It can thus traverse guide space 15 suspended at a specified height above the surface 1*d*.

The intermediate cylinder 27 and impression cylinder 23 are rotating in directions S and N as indicated in FIG. 1. Because the viscosity of the air produces drag near the surface of the cylinders, maximizing the surface velocity v which corresponds to the rotational velocity of the cylinders will produce an air flow with a distributed velocity (turbulent boundary layer 37).

When the sheet 11 being conveyed while suspended within the guide space 15 enters the vicinity of the reception area 030, the turbulent boundary layer 37 which forms over the impression cylinder 23 causes the end of the sheet to flutter as it moves past indentations 10, the protrusions arrayed like the teeth of a comb on the end of sheet guide surface 1*d*, as shown in FIG. 2. This results in movement and flapping.

If sheet 11 is a sheet of a thinner paper and a skeleton cylinder is used as intermediate cylinder 27, when its end leaves the pawls of the skeleton cylinder 27 (27*a*) and it is conveyed as the cylinders rotate onto the next cylinder, impression cylinder 23, the space between the impression and intermediate cylinders will be large relative to the thin paper, and it will lose its support. At this point the influence of the turbulent boundary layer 37 on the surface of the impression cylinder will cause the sheet 11 not to conform to the contour of impression cylinder 23, but to behave in an unstable fashion, possibly buckling or flapping.

In this embodiment, a second air chamber 30 is created on the rear portion of the downstream segment of surface 1*d* of the sheet guide unit 1. Air is blown at a high velocity through second air vents 22, which run along air guide side wall 34*b* facing space 21 in the vicinity of reception area 030, the area between intermediate cylinder 27 and impression cylinder 23. This air is directed toward the rotary surface of the impression cylinder, and it travels along the portion of the surface which is covered by hood 19. The outlet of space 21 is formed into a nozzle. By ejecting the air from space 21, we create a stream of air. The venturi effect or ejects effect caused by the narrowing of the stream as it is compressed between intermediate cylinder 27 and impression cylinder 23, and the aspirating the air from the indented portion 10, creates a negative pressure below the sheet 11 which is passing through indented portion 10 on the end of sheet guide surface 1*d*. This imparts a moderate degree of tension to sheet 11, allowing it to behave in a stable fashion on the surface of impression cylinder 23.

The air stream is directed so as to cancel the distributed velocity of the turbulent boundary layer 37 created on impression cylinder 23 by vortices (i.e., it is directed toward the tangent of the two cylinders). This will result in the behavior of sheet 11 being stabilized on impression cylinder 23 after it is transferred from intermediate cylinder 27. Even if sheet 11 is thin and intermediate cylinder 27 is a skeleton cylinder, the sheet 11 can be conveyed without any perturbations.

Because the air in the vicinity of the reception area 030 is collected and drawn into hood 19, it has no opportunity to disperse. This prevents sheet 11 from being adversely affected by dispersing air currents. The sheet 11 is transferred smoothly from the intermediate cylinder 27 to the next cylinder, impression cylinder 23.

In this embodiment, as has been discussed, a portion of the air aspired by air pump 13 passes through the outlet of the pump 13, into supply pipe 6*b*, and through pipe 6*b* into the air supply chamber 2. The rest of it passes through supply pipe 6*a* into the second air chamber 30. The air vents 22 provide a route by which the air can return and be recirculated. This scheme enhances the stability of the flow generated by the venturi effect and prevents the rotation of impression cylinder 23 from creating a turbulent boundary layer 37. Since the air can be continuously recirculated in the system, there is no need for extraneous air. This results in a lower expense for air. And because only a single air pump 13 is required, the equipment cost is also reduced.

In the embodiment, the sheet guide unit 1 is provided on intermediate cylinder 27. However, the scope of this invention would also allow a sheet guide unit 1 to be provided on the first intermediate cylinder and on the delivery cylinder (or shaft).

With this embodiment, then, the sheet will be conveyed smoothly even when a thinner grade of paper and a skeleton cylinder are used.

Because the air in the vicinity of the reception area is collected and drawn into a hood, it has no opportunity to disperse, and the sheet is not adversely affected by dispersing air currents.

Figure 3:
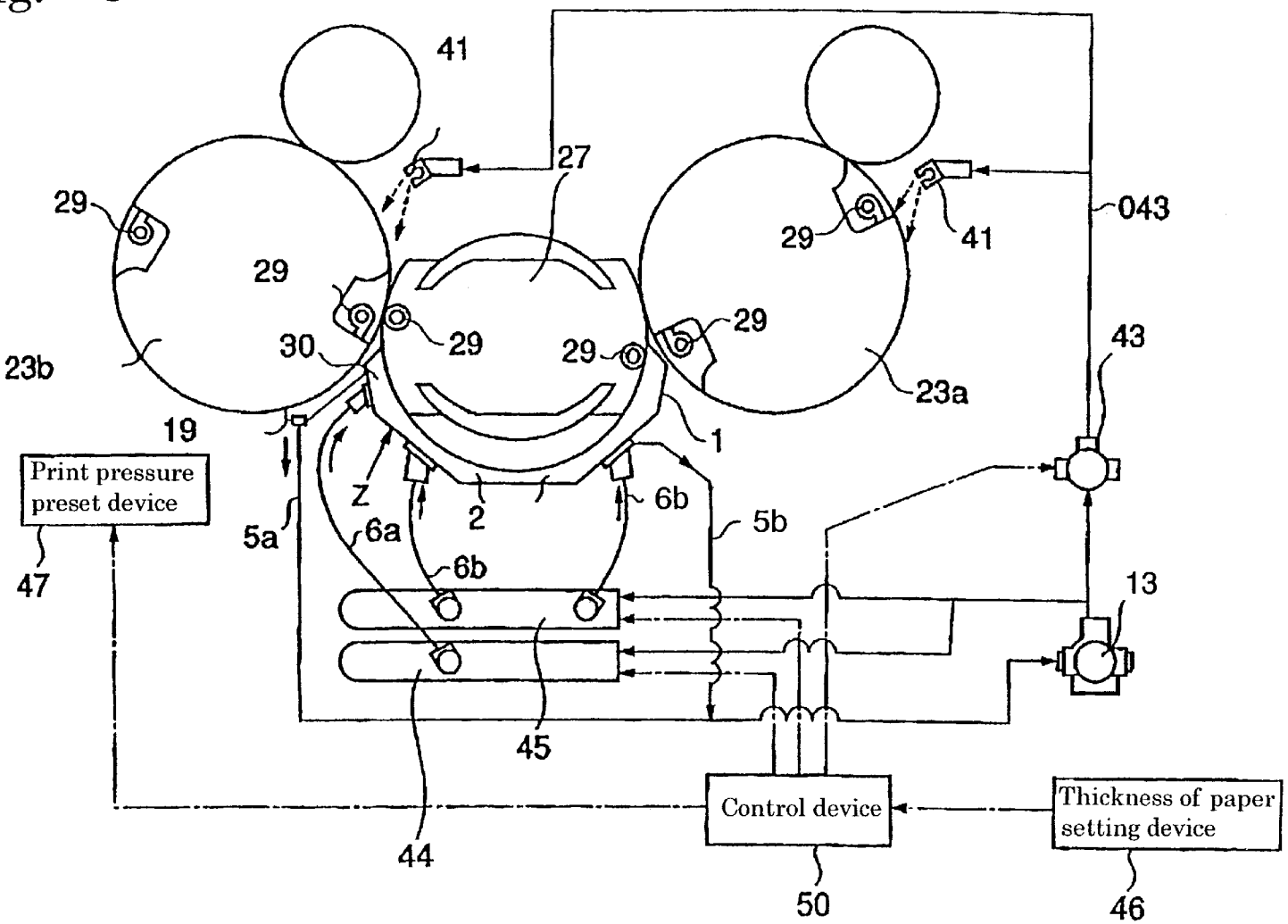
FIG. 3 shows the overall configuration of second embodiment of a sheet-fed press according to this invention. It shows the parts of the press involved with controlling the movement of the sheet near the intermediate cylinder.

FIG. 3 shows the overall configuration of another embodiment of a sheet-fed press according to this invention. It shows the parts of the press involved with controlling the movement of the sheet near the intermediate cylinder. We shall focus our discussion on how this embodiment differs from the previous one. In this embodiment, a single air pump 13 is used to fill the first air supply chamber 2 and the second air supply chamber 30 and to draw air into hood 19.

Figure 5:
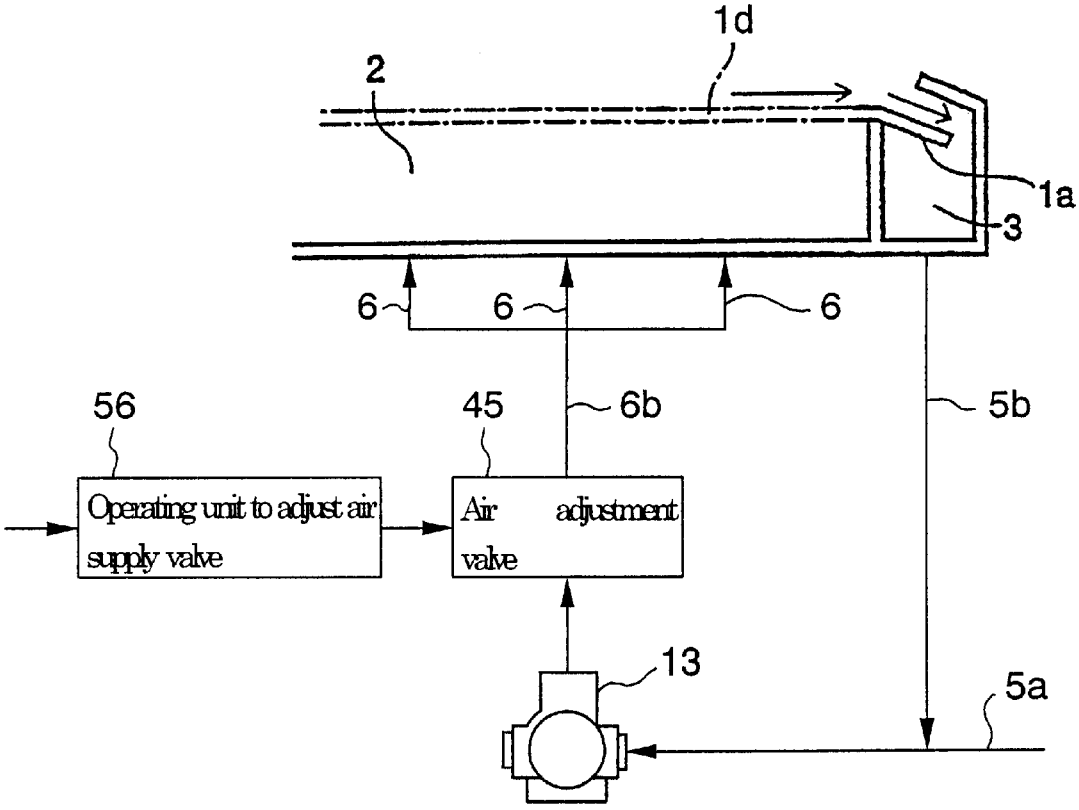
FIG. 5 shows the cross section of the first air supply chamber and aspiration chamber, and it show the how the air flows.

Aspiration pipe 5*b* is connected to aspiration pipe 5*a* and air chamber 3 (see FIG. 5). Aspiration pipe 5*a* is connected to chamber 31 on the bottom of hood 19. The two pipes, 5*a* and 5*b*, feed into a single aspiration pipe, which is connected to the inlet of air pump 13.

41 is an air jet unit which is a third air vent. It is adjacent to reception area 030 (the most constricted portion) between intermediate cylinder 27 and the next stage downstream from it, impression cylinder 23. Air jet unit 41 is placed directly above the reception area 030 so that its nozzle can direct a stream of air across the entire width of the reception area.

44 is a valve to adjust the supply of air. The inlet side of this valve is connected to the output side of air pump 13. The output side is connected to air supply pipe 6*a*, which goes into the second air supply chamber 30. Based on a control signal from control device 50, this valve allows or prevents the supply of air to the second air chamber 30 and adjusts the pressure of the air being supplied.

45 is a valve to adjust the supply of air to the first air supply chamber 2. Its inlet side is connected to the outlet side of air pump 13; its outlet side is connected to the air supply pipe 6*b*. Based on control signals from control device 50 and operating unit 56 (not shown in the figure), which operates the valve to adjust the supply of air, the volume and pressure of the air supplied to the first air supply chamber 2 are adjusted.

47 is a device to preset the print pressure. It is used to set the pressure with which the sheet 11 will be printed, and is well known in the art.

43 is a jet-switching valve to switch the air jet. It is connected to the air jet unit 41 via pipe 043. Based on a control signal from control device 50, it might, for example, be made to open for a thicker paper and close for a thinner paper. The outlet of air pump 13 is connected to the adjustment valves 44 and 45 and the jet-switching valve 43.

We shall next explain the arrangement of the first air supply chamber 2 and aspiration chamber 3 with reference to FIG. 5.

Guide fin 1*a* and aspiration chamber 3 are behind a partition on either side of the first air supply chamber 2, which is constructed on the entire rear portion of surface 1*d* of the sheet guide unit 1, with the exception of the outlet.

Aspiration chamber 3 is connected to the inlet side of the air pump 13. The first air supply chamber 2 is connected to the outlet side of air pump 13 via control valve 45 and the air supply pipe.

Figure 4:
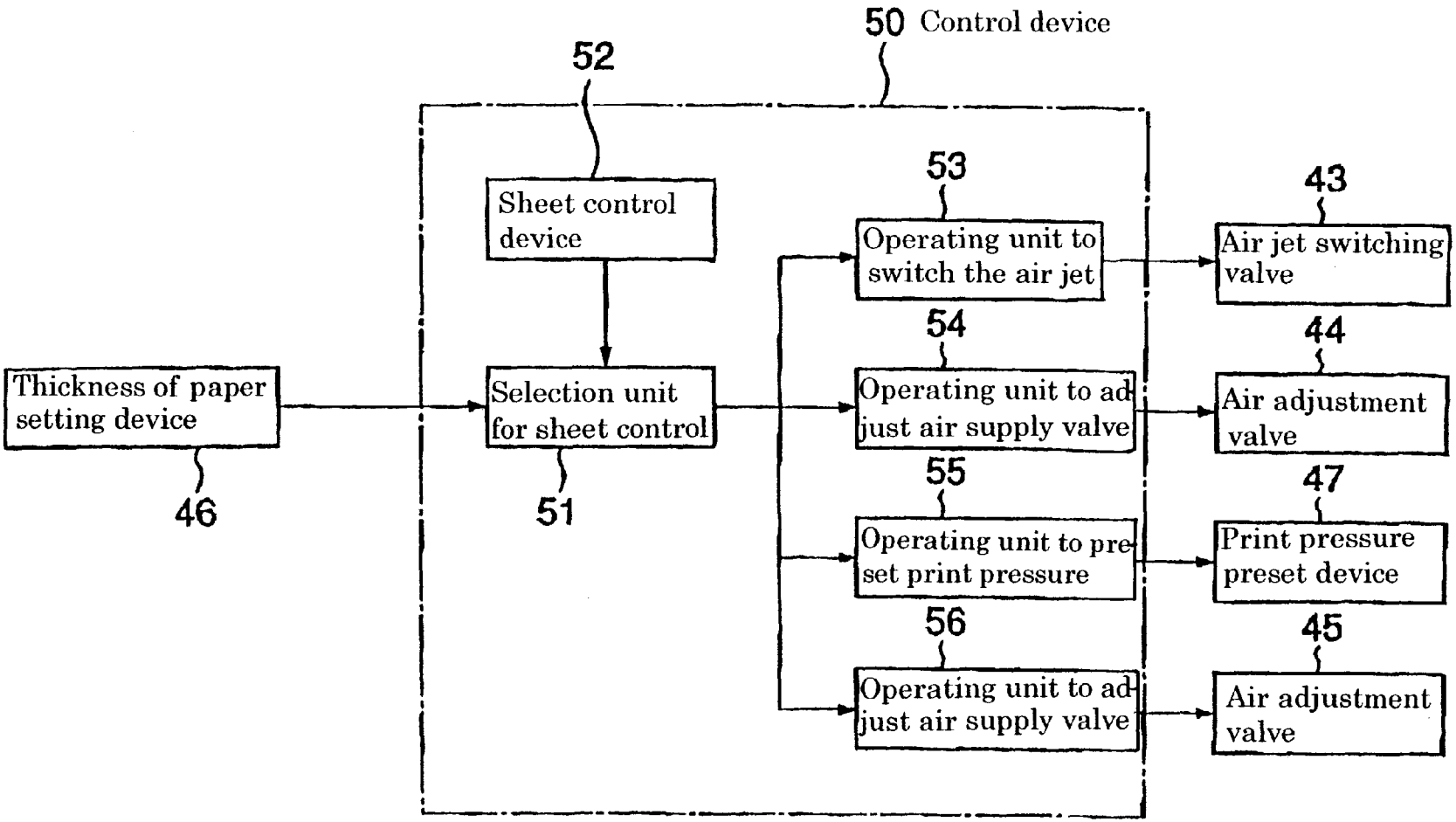
FIG. 4 shows the control block drawing for the embodiment in FIG. 3.

We shall next explain how this embodiment is controlled with reference to FIG. 4.

46 is a device to establish the thickness of the paper. The device 46 establishes the thickness of an individual sheet 11 of the paper to be printed, and it inputs the result, "thick" (1.2 to 0.2 mm), "medium" (0.2 to 0.12 mm) or "thin" (0.12 to 0.04 mm), to selection unit 51 of control device 50. Based on the thickness of the sheets to be printed as established by the device 46, control device 50 outputs control signals to govern, through operating unit 54, whether and how much to open adjustment valve 44 (fully open for thin paper; fully closed for thick paper; partially open for medium paper); through operating unit 56, whether and how much to open adjustment valve 45 (least open for thin, most open for thick); and through operating unit 53, whether to open jet-switching valve 43 (closed for thin paper, open for thick, either or partially open for medium). It also sends a control signal to device 47 to preset the print pressure via the operating unit 55. All of these mechanisms, then, are governed by control device 50.

52 is the unit which sets up the sheet control. In response to the thickness of the sheet 11, it initiates signals to open, close or partially open the valves for each type of paper.

As has been discussed, the signals stored in unit 52 operate as follows. If the thickness of sheet 11 is in the "thick" range, the air jet unit 41 is opened and adjustment valve 45 is fully opened so that the volume of air aspirated by pipe 5*b* is reduced. If sheet 11 falls into the "thin" range, the air jet unit 41 is closed, adjustment valve 44 is opened, and adjustment valve 45 is partially closed. If sheet 11 falls into the "medium" range, air jet unit 41 and adjustment valve 44 are selectively or simultaneously operated, and the adjustment valve 45 is opened halfway. When all of these valve control signals are combined, device 47 presets the print pressure according to the thickness of the paper.

Selection unit 51 selects data to control the movement of the sheet 11 according to the thickness range which has been input for it. It selects these data based on the thickness of sheet 11 that is input by the device 46 and control data concerning the movement of the sheet which are established by the sheet control unit 52.

We shall next explain how control is implemented in a sheet-fed press configured as described above.

A signal representing the thickness of the paper which is input by the device 46 is sent to the operating unit 55 of the device to preset the print pressure, and the appropriate print pressure for that thickness is set by pressure presetting device 47.

If the thickness input by the thickness setting device 46 is in the "thin" range, the sheet selection unit 51 transmits signals to close the air jet unit 41, open adjustment valve 44 and partially close adjustment valve 45. These signals are input into operating unit 53, which switches the air jet, and operating units 54 and 56, which operate the valves to adjust the air supply.

In response to these signals, operating unit 53 closes the jet switching valve 43, cuts off the air jet from air jet unit 41, partially closes adjustment valve 45, and opens adjustment valve 44. This arrangement allows sheet 11 to be conveyed in a stable fashion.

When sheet 11 is sent from the impression cylinder 23*a* of the previous stage, it engages with the pawls 29 of the skeleton-type intermediate cylinder 27 and is directed into and through the space 15 between the intermediate cylinder 27 and the sheet guide unit 1.

At this point a constricted stream of air is supplied through the adjustment valve 45 to first air supply chamber 2, which is located in the upstream portion of the path S which the sheet travels in the sheet guide unit 1. This air is directed through numerous vents 4 against the bottom of sheet 11 as it passes through the space 15. As was explained earlier, this causes a pressure differential between the air above and below sheet 11 as it travels. The Bernoulli effect occasioned by the air stream causes the sheet to be suspended at a specific height over guide surface 1*d* as it travels through the space 15.

The air which flows through the space 15, as indicated by the arrows in FIG. 5, enters the channel formed by the fin 1*a* and the outer wall of aspiration chamber 3 and from there flows into the chamber.

Because fin 1*a* is provided on the outlet of the space 15, and because valve 45 is adjusted so as to supply a larger volume of air to aspiration chamber 3 than to first air supply chamber 2, the air which flows out of the space 15 from under sheet 11 and is no longer needed can be recirculated very effectively. The layer of air over sheet guide surface 1*d* will also be effectively drawn into aspiration chamber 3.

The sheet 11 will then be transferred from intermediate cylinder 27*a* to the next skeleton cylinder 22*b* and impression cylinder 23*b*, which will execute the next process, i.e., print the next color. When the sheet is in the downstream portion of its path S in the space 15, the end of the sheet will be released by pawls 29 of the skeleton-type intermediate cylinder 27 (27*a*).

At this point, as can be seen in FIG. 3, compressed air which is controlled by adjustment valve 44 is supplied by the air pump 42 to the second air supply chamber 30, located in the downstream segment of the path S traveled by the sheet through the space 15. From air vents 22, which range along the width of air guide side wall 34*b* facing air space 21 in the vicinity of reception area 030 between intermediate cylinder 27 and impression cylinder 23, a stream of high-velocity air is directed through space 21 and along the surface of impression cylinder 23, which is covered by hood 19. In the embodiment, as we have explained, the venturi effect which occurs because of the constricted airflow between intermediate cylinder 27 and impression cylinder 23 creates a negative pressure below sheet 11 as it passes through indentations 10 at the end of surface 1*d* of the sheet guide unit.

This gives a thin sheet 11 an appropriate tension which allows it to advance in a stable fashion on impression cylinder 23. The air stream is directed so as to cancel the distributed velocity of the turbulent boundary layer 37 formed by vortices on impression cylinder 23 (i.e., it is directed toward the tangent of the two cylinders). When sheet 11 is transferred from intermediate cylinder 27 onto impression cylinder 23, it will advance in a stable fashion. Even if a thinner paper is being printed and intermediate cylinder 27 is a skeleton cylinder, the sheet 11 will not flutter or flap, but will progress smoothly.

If the thickness of sheet 11 input by the device 46 falls into the "thick" range, selection unit 51 transmits signals to open the air jet unit 41 and fully open adjustment valve 45 so that a smaller volume of air is aspirated by pipe 5*b*.

As a result, when the sheet 11 which is sent onto by the impression cylinder 23*a* of the previous stage is taken up by the pawls 29 of the skeleton-type intermediate cylinder 27 and passes through space 15 between the intermediate cylinder and the sheet guide unit 1, the adjustment valve 45 supplies more air than it did for the thin sheet to chamber 2, which is located in the upstream portion of the path S which the sheet travels in the sheet guide unit 1. Even when a thick sheet 11 is so rigid that its rear end bends so that its front end comes in contact with surface 1*d* of the sheet guide unit 1, air can be supplied at a pressure high enough to counteract this effect, and sheet 11 can be made to pass through the space 15 at a specified height above the surface 1*d*. The air which flows through the space 15, as indicated by the arrows in FIG. 5, enters the channel formed by the fin 1*a* and the outer wall of aspiration chamber 3 and from there flows into the chamber. The layer of air over sheet guide surface 1*d* will also be effectively drawn into aspiration chamber 3.

When jet switching valve 43 is opened, the stream of air from air pump 42 passes through the valve 43 and pipe 043 and flows into the air jet unit 41. From there it is directed at the reception area between the intermediate cylinder 27 and the next impression cylinder 23.

In the reception area 030 for the next impression cylinder 23 which the sheet enters after passing through the space 15, a circular flow in direction N is created by the rotation of cylinders 27 and 23. However, the pressurized air stream from the air jet unit 41 which is directed toward the reception area 030 between the cylinders presses from above on the sheet which has been taken up by the next impression cylinder 23. This will prevent a thicker sheet from buckling or flapping.

If the sheet is of medium thickness, as has been discussed, a stream of pressurized air from air jet unit 41 is produced whose pressure is sufficient to cancel the distributed velocity of the circular flow. This prevents the circular flow from causing the end of sheet 11 to flap; however, the pressurized air disperses in the vicinity of the reception area 030, so a paper of medium thickness might still experience buckling or flapping.

For a paper of medium thickness, then, operating unit 53 opens the jet switching valve 43 to produce a jet of pressurized air from air jet unit 41, as described above, and the operating unit 54 opens adjustment valve 44 to adjust the volume of air supplied to the second air supply chamber 30. Air is blown through vents 22 in air guide side wall 34*b* to prevent the end of the sheet 11 from buckling or flapping.

In the embodiment we have been discussing, the passage of the sheet was controlled in the reception area 030 between intermediate cylinder 27 and the next impression cylinder 23. However, the invention can also be applied in just the same way to the first intermediate cylinder or the delivery cylinder.

With this embodiment, then, even with a single press, we can minimize undesirable instability which occurs when the sheet is passing through the sheet guide unit or the reception area. We can convey a wide range of thicknesses of paper in a stable fashion, without buckling or flapping, even when a skeleton cylinder is employed.

What is claimed is:

1. A sheet-fed press, comprising:

a first press cylinder which is an intermediate or delivery cylinder with a sheet guide unit having an arced form provided under the lower surface, and which comprises a space through which a sheet passes;

a second press cylinder which is an impression cylinder positioned adjacent to said first press cylinder via a reception area;

a first air supply chamber in the rear side of the sheet guide surface which is located in the upstream segment of the flow of the sheet, a first air vent in the upstream segment through which air from said first air supply chamber is blown onto the sheet, a second air supply chamber in the rear side of the sheet guide surface which is located in the downstream segment of the flow of the sheet;

a second air vent in the downstream segment of the reception area through which air from said second air supply chamber is blown in the direction that said second cylinder is rotating, and an air drawing means to draw the air flowing along the path of rotation of said second press cylinder, which is provided on the downstream side of said second air vent.

2. A sheet-fed press according to claim 1, further comprising an air guide side wall facing along the circumference of said second press cylinder, which is located at the downstream from said second air vent of said second air supply chamber, and guides the air from said second air vent so as to flow along said air guide side wall toward the tangent of said second cylinder.

3. A sheet-fed press according to claim 2, wherein said air guide side wall comprises a side wall on which said second air vent of said second air supply chamber is formed.

4. A sheet-fed press according to claim 2, wherein the downstream portion of said air guide side wall gradually narrows as it approaches said second press cylinder, the venturi effect which occurs on the downstream portion of said air guide side wall will produce a negative pressure on the lower surface of the sheet being conveyed, and further produce a flow which can counteract the vortex near the surface created by the rotation of said second press cylinder.

5. A sheet-fed press according to claim 1, wherein said air drawing means is a hood which extends along the breadth of the air guide side wall so as to cover the rotary surface of said second press cylinder downstream from the reception area.

6. A sheet-fed press according to claim 1, wherein the quantity of air drawn into said air drawing means is greater than the quantity blown through said second air vent.

7. A sheet-fed press according to claim 1, further comprising an air return channel so that at least a portion of the air drawn in by said air drawing means is recirculated to said second air supply chamber.

8. A sheet-fed press according to claim 1, wherein the first press cylinder is a skeleton cylinder.

9. A sheet-fed press, comprising;

a first press cylinder which is an intermediate or delivery cylinder with a sheet guide unit having an arced form provided under the lower surface, and which comprises a space through which a sheet passes;

a second press cylinder which is an impression cylinder positioned adjacent to said first press cylinder via a reception area;

a first air blowing means to blow an air stream into the space along said sheet guide unit and said first press cylinder so that the sheet is suspended slightly above the sheet guide surface of said sheet guide unit as the sheet is conveyed;

a second air blowing means in the downstream segment of the reception area which supplies the air flow in the direction that said second cylinder is rotating;

a third air blowing means to supply the air flow by an air jet unit to blow air toward the reception area between said two press cylinders from a point upstream from that reception area; and an air control means to control the air flows to said second and third air blowing means, by selecting one of said second and third air blowing means according to the thickness of the sheet being conveyed from the surface of said sheet guide unit, or by constricting the volume of air supplied to said second and third air blowing means.

10. A sheet-fed press according to claim 9, wherein:

said air control means constricts the volume of air supplied to said first air blowing means according to the thickness of the sheet.

11. A sheet-fed press according to claim 9, wherein said air control means controls the air flows such that, if the sheet of a thicker paper is being conveyed from said sheet guide unit to the reception area, said air control means selects said third air blowing means to blow air toward the reception area between said two press cylinders from a point upstream, and if a sheet of thinner paper is being conveyed, it selects said second air blowing means, which is downstream from the reception area between said two press cylinders, to blow air toward said second press cylinder.

12. A sheet-fed press according to claim 9, wherein said air control means not only controls the control signals for selecting said air blowing means or constricting the volume of airflow supplied to the air blowing means, but also selects a preset signal for the pressure to be exerted on said cylinders according to the thickness of the paper.

* * * * *